US007404449B2

(12) United States Patent
Bermingham et al.

(10) Patent No.: US 7,404,449 B2
(45) Date of Patent: Jul. 29, 2008

(54) PILE DRIVING CONTROL APPARATUS AND PILE DRIVING SYSTEM

(75) Inventors: Patrick Donald Bermingham, Hamilton (CA); Mark Triska, Ancaster (CA); Michael Justason, Hamilton (CA); David Hoover, Hamilton (CA); Stefano Gabaldo, Hamilton (CA); Peter Middendorp, Voorburg (NL); William Codd, Hamilton (CA)

(73) Assignee: Bermingham Construction Limited, Hamilton (CA)

( * ) Notice: Subject to any disclaimer, the term of this patent is extended or adjusted under 35 U.S.C. 154(b) by 0 days.

(21) Appl. No.: 11/601,712

(22) Filed: Nov. 20, 2006

(65) Prior Publication Data

US 2007/0074881 A1 Apr. 5, 2007

Related U.S. Application Data

(63) Continuation-in-part of application No. 10/843,664, filed on May 12, 2004, now Pat. No. 7,156,188.

(60) Provisional application No. 60/469,415, filed on May 12, 2003.

(51) Int. Cl.
*E02D 13/00* (2006.01)

(52) U.S. Cl. ..... 173/2; 173/128; 405/232; 73/11.03

(58) Field of Classification Search ..... 173/2, 173/4, 10, 11, 13, 20, 128, 176; 73/11.03, 73/84, 12.01; 356/141.1; 340/853.8; 405/229, 405/232

See application file for complete search history.

(56) References Cited

U.S. PATENT DOCUMENTS 2,804,856 A 9/1957 Spurlin (Continued)

OTHER PUBLICATIONS

Wondem Teferra et al., "Driving Stress Control During the Installation of Precast Prestressed Cylindrical Concrete Piles", Reference Papers, http://web.pile.com/Education/sw1/default.asp?company=, 7 pages, 1996.

(Continued)

*Primary Examiner*—Scott A. Smith
(74) *Attorney, Agent, or Firm*—Nixon & Vanderhye P.C.

(57) ABSTRACT

A pile driving control apparatus for a pile driving system includes a hydraulic control system that controls a throttle of a pile driving hammer, and thereby controls an impact velocity of the hammer with a pile. A controller provides a control signal to the hydraulic control system. Based on the control signal, the hydraulic control system controls an impact velocity of the hammer during a subsequent hammer stroke. The controller may determine one or more control parameters such as sound pressure at a sound control location during a hammer stroke, vibration at a vibration control location during a hammer stroke, an impact force imparted to the pile during a hammer stroke, and/or actual pile capacity of the pile, and provide to the hydraulic control system a control signal based on the determined control parameter(s).

15 Claims, 2 Drawing Sheets

U.S. PATENT DOCUMENTS

| | | | | |
|---|---|---|---|---|
| 3,747,693 | A | 7/1973 | Kummel et al. | |
| 4,096,916 | A | 6/1978 | Hennecke et al. | |
| 4,365,306 | A | 12/1982 | House et al. | |
| 4,508,181 | A | 4/1985 | Jenne | |
| 4,586,366 | A | 5/1986 | Milberger | |
| 4,660,655 | A | 4/1987 | Wilner | |
| 4,860,835 | A | 8/1989 | Mauch | |
| 5,090,485 | A | 2/1992 | Pomonik et al. | |
| 5,170,358 | A * | 12/1992 | Delio | 700/177 |
| 5,303,162 | A | 4/1994 | Yoon | |
| 5,548,397 | A | 8/1996 | Kool et al. | |
| 5,581,013 | A | 12/1996 | Frederick | |
| 5,610,818 | A | 3/1997 | Ackroyd et al. | |
| 5,727,639 | A | 3/1998 | Jeter | |
| 5,978,749 | A | 11/1999 | Likins, Jr. et al. | |
| 6,301,551 | B1 | 10/2001 | Piscalko et al. | |
| 6,510,902 | B1 * | 1/2003 | Prokop et al. | 173/1 |
| 6,533,502 | B2 | 3/2003 | McVay et al. | |
| 7,156,188 | B2 * | 1/2007 | Bermingham et al. | 173/2 |
| 7,231,989 | B2 * | 6/2007 | Salminen et al. | 173/1 |

OTHER PUBLICATIONS

Bengt H. Fellenius, Dr. Tech., P. Eng., "Piling Terminology", Basics of Foundation Design, Second Expanded Edition, 1999, http://www.geoforum.com/info/pileinfo/terminology.asp, 8 pages.

"Pile Classification System", Pile Info, http://www.geoforum.com/info/pileinfo/classification.asp, 1 page, copyright 1998-2005.

Frank Rausche et al., "Dynamic Determination of Pile Capacity", Reference Papers, http://web.pile.com/Education/540/default.asp?company=, 17 pages, 1985.

Frank Rausche et al., "Soil Resistance Predictions From Pile Dynamics", Reference Papers, http://web.pile.com/Education/502/default.asp?company=, 15 pages, Sep. 1972.

Garland Likins et al., "Introduction to the Dynamics of Pile Testing", Reference Papers, http://web.pile.com/Education/621/default.asp?company=, 4 pages, Dec. 1990.

"Short history of piling", Pile Info, http://www.geoforum.com/info/pileinfo/view_process.asp?ID=56, 2 pages, copyright 1998-2005.

* cited by examiner

PILE DRIVING CONTROL APPARATUS AND PILE DRIVING SYSTEM

CROSS-REFERENCE TO RELATED APPLICATIONS

This application claims the benefit of, and is a continuation-in-part of, U.S. patent application Ser. No. 10/843,664, which was filed on May 12, 2004, now U.S. Pat. No. 7,156,188 claiming the benefit of U.S. Provisional Patent Application Ser. No. 60/469,415, filed on May 12, 2003.

The entire contents of each of these related patent applications is incorporated herein by reference.

FIELD OF THE INVENTION

This invention relates to pile drivers and, more particularly, to pile drivers with control systems.

BACKGROUND

Pile drivers are used in the construction industry to drive piles, also known as posts, into the ground. Piles are used to support massive structures such as bridges, towers, dams and skyscrapers. Piles, or posts, may be made of timber, steel, concrete or composites. Driving a pile into the ground requires high impact energy to overcome soil resistance. However, the impact energy must not be so large as to damage the pile during installation.

Impact stresses are directly related to the impact energy delivered to the pile by a driving element such as a hammer. During impact, the energy transferred to the pile is a function of force, F(t), and velocity, v(t), both of which vary in time. The impact energy as a function of time, E(t), is calculated as follows:

$$E(t)=\int F(t)v(t)dt.$$

The impact energy may be approximated to be the kinetic energy of a pile driving hammer just before it impacts the pile head, i.e., $E=\frac{1}{2}mv^2$. However, not all of this kinetic energy is transferred to the pile because of the inelasticity of the collision, which results in deformation and energy dissipation in the form of heat and sound.

There are a variety of pile driving machines currently known in the industry. There are simple drop-hammer pile drivers that use a cable, winch and crane to raise a mass above the pile and simply let the hammer free-fall onto the top of the pile (also known as the pile head), as illustrated in U.S. Pat. No. 4,660,655 (Wilner). Sometimes the drop hammer has a vertical guide or rail to ensure greater accuracy during the drop. These guided drop hammers are shown in U.S. Pat. No. 5,978,749 (Likins, Jr. et al.) and in U.S. Pat. No. 6,301,551 (Piscalko et al.). Pile drivers may also be hydraulically actuated as in U.S. Pat. No. 5,090,485 (Pomonik et al.) or pneumatically driven as in U.S. Pat. No. 4,508,181 (Jenne). There are also diesel-powered pile drivers (which are also known as free piston internal combustion pile drivers). The diesel pile driver uses the piston as the impacting hammer. This type of pile driver is described in U.S. Pat. No. 5,727,639 (Jeter).

One of the main recurrent problems in pile driving is controlling the impact of the hammer on the pile. If the impact energy is too little, the pile does not penetrate the soil and time and energy is lost. If the impact energy is too great, the pile may be damaged or broken. Indeed, concrete piles are susceptible to cracking if the impact stresses are too large.

Traditionally, foundation engineers have relied on static or dynamic analyses, probe piles and static testing to ensure a safe and efficient installation. However, the dynamic formulae are intrinsically inaccurate because the dynamic modeling of the hammer, driving system, pile and soil is based on simplifications and assumptions that do not always simulate reality. Even if dynamic models were further refined, they would still not be able to account for the fact that soil conditions may vary with depth or may change due to repetitive impacting. Recent attention has been paid to the question of measuring the impact energy transferred from the hammer to the pile. In U.S. Pat. No. 5,978,749, Likins Jr. discloses a system for recording data from sensors. The impact energy for the subsequent impact is then manually adjusted, for example, by varying the drop height of the drop-hammer pile driver or by throttling the diesel pile driver to vary the ram stroke. Likewise, in U.S. Pat. No. 6,301,551 (Piscalko et al.), a pile driver analyzer (PDA) collects data from sensors located on the pile itself.

However, certain drawbacks are evident from the prior art designs. The manual control of impact energy is both time-consuming and inaccurate. The types of parameters that can be used to control pile driving also tend to be limited.

Accordingly, an improved means of controlling the impact energy of the hammer in a pile driver is needed.

SUMMARY OF THE INVENTION

It is thus an object of embodiments of the present invention to provide an improved control system for a pile driver. In some embodiments, a pile driver is controlled on the basis of sound pressure and/or vibration measurements made at sound and vibration control locations. Control locations may be provided at any of various physical locations near a pile driving site.

According to an aspect of the invention, there is provided a pile driving control apparatus that includes a hydraulic control system operable to control a throttle of a pile driving hammer to thereby control an impact velocity of the hammer with a pile, and a controller operatively coupled to the hydraulic control system. The controller is operable to determine sound pressure at a control location during a hammer stroke, and to provide to the hydraulic control system a control signal based on the determined sound pressure. The hydraulic control system controls an impact velocity of the hammer during a subsequent hammer stroke based on the control signal.

The controller may also be operable to determine an impact velocity of the hammer during the hammer stroke by receiving a reading from a velocity sensor for measuring the impact velocity of the hammer.

In some embodiments, the controller is operable to determine the sound pressure by receiving a reading from a sound pressure sensor for measuring the sound pressure at the control location.

The control location may be a location on the hammer, a location on the pile, a location on ground into which the pile is to be driven, or a location on a structure near the pile, for example.

The controller may also be operable to determine vibration at a vibration control location during the hammer stroke, and to generate the control signal based on the determined sound pressure and the determined vibration. The control location and the vibration control location may be the same physical location or different physical locations.

In some embodiments, the controller is further operable to provide the control signal by comparing the determined sound pressure to a maximum allowable sound pressure, and generating, as the control signal, a control signal to cause the hydraulic control system to adjust the throttle so as to adjust the impact velocity of the hammer for the subsequent hammer stroke based on the comparison.

A pile driving system may include such a pile driving control apparatus, a hammer having a throttle operatively coupled to the hydraulic control system, and a sound pressure sensor, operatively coupled to the controller, and operable to measure the sound pressure at the control location and to provide to the controller an indication of the measured sound pressure.

The sound pressure sensor may be provided in a system for analyzing the sound pressure at the control location, in which case the indication of the measured sound pressure may be a sound pressure analysis output.

Another aspect of the invention provides a pile driving control apparatus that includes a hydraulic control system operable to control a throttle of a pile driving hammer to thereby control an impact velocity of the hammer with a pile, and a controller operatively coupled to the hydraulic control system and operable to determine vibration at a control location during a hammer stroke. The controller provides to the hydraulic control system a control signal based on the determined vibration, and the hydraulic control system controls an impact velocity of the hammer during a subsequent hammer stroke based on the control signal.

The controller in such an apparatus may be further operable to determine an impact velocity of the hammer during the hammer stroke by receiving a reading from a velocity sensor for measuring the impact velocity of the hammer.

Vibration may be determined by the controller by receiving a reading from a vibration sensor for measuring the vibration at the control location.

The control location may be a location on the hammer, a location on ground into which the pile is to be driven, and a location on a structure near the pile, for example.

In some embodiments, the controller is further operable to provide the control signal by comparing the determined vibration to a maximum allowable vibration, and generating, as the control signal, a control signal to cause the hydraulic control system to adjust the throttle so as to reduce the impact velocity of the hammer for the subsequent hammer stroke based on the comparison.

This type of pile driving apparatus may be implemented, for instance, in a pile driving system that also includes a hammer having a throttle operatively coupled to the hydraulic control system, and a vibration sensor, operatively coupled to the controller, and operable to measure the vibration at the control location and to provide to the controller an indication of the measured vibration.

The vibration sensor may be provided in a system for analyzing the vibration at the control location. The indication of the measured vibration may then be a vibration analysis output.

There is also provided a pile driving control apparatus that includes a hydraulic control system operable to control a throttle of a pile driving hammer to thereby control an impact velocity of the hammer with a pile, and a controller operatively coupled to the hydraulic control system and operable to determine an actual impact force imparted to the pile during the hammer stroke. The controller is also operable to compare the determined actual impact force with a target impact energy, and to provide to the hydraulic control system a control signal based on the comparison. The hydraulic control system controls an impact velocity of the hammer during a subsequent hammer stroke based on the control signal.

The target impact energy may be configurable by a user.

A further aspect of the invention provides a pile driving control apparatus that includes a hydraulic control system operable to control a throttle of a pile driving hammer to thereby control an impact velocity of the hammer with a pile, and a controller operatively coupled to the hydraulic control system and operable to determine actual pile capacity of the pile, to compare the determined actual pile capacity with a target pile capacity, and to provide to the hydraulic control system a control signal based on the comparison, the hydraulic control system controlling an impact velocity of the hammer during a subsequent hammer stroke based on the control signal.

In some embodiments, the target pile capacity is configurable by a user.

Other aspects and features of embodiments of the present invention will become apparent to those ordinarily skilled in the art upon review of the following description.

BRIEF DESCRIPTION OF THE DRAWINGS

Examples of embodiments of the invention will now be described with reference to the accompanying drawings wherein.

Figure 1:
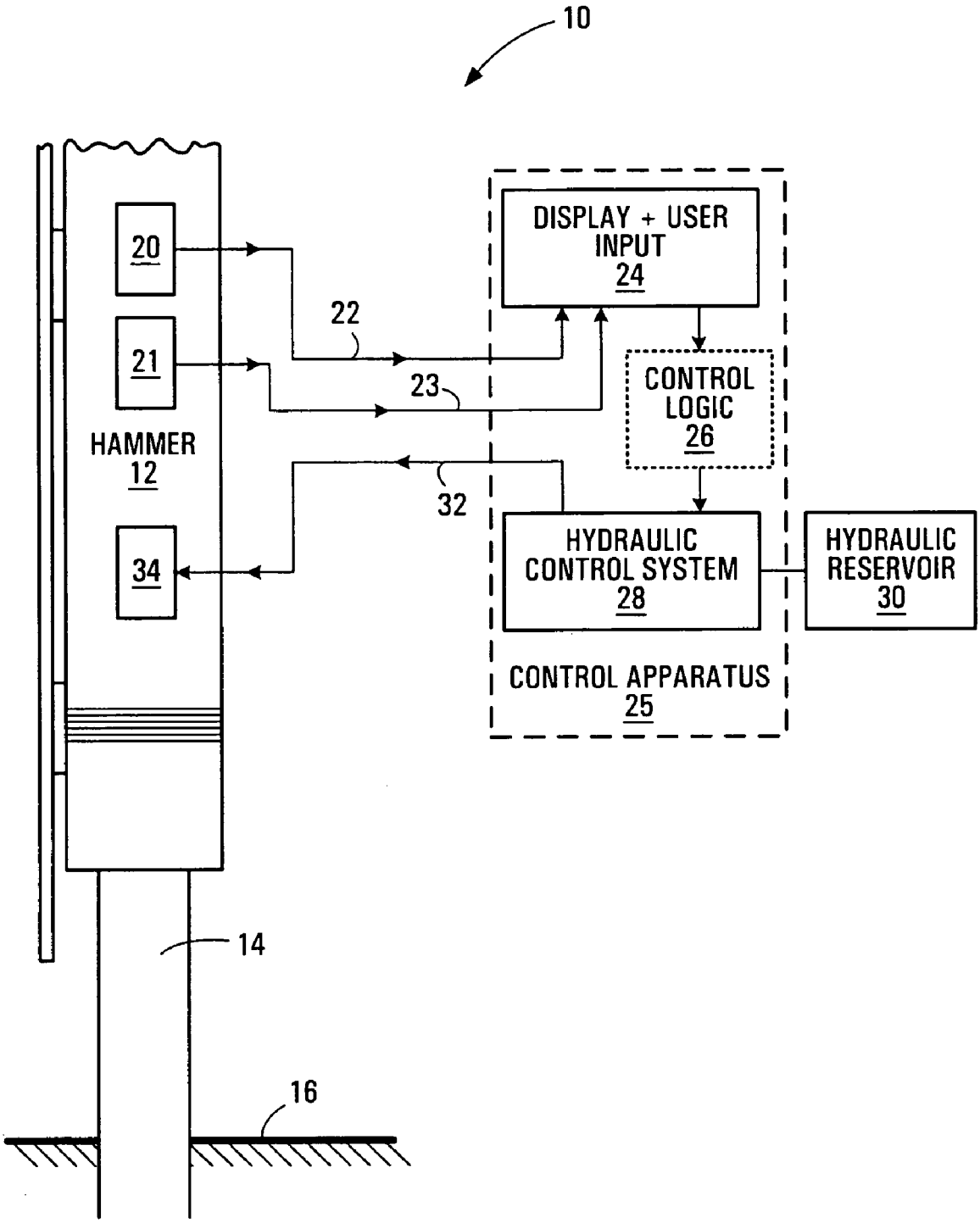
FIG. 1 is a schematic of a pile driving system with feedback control in accordance with one embodiment of the present invention.

In the drawings, preferred embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF PREFERRED EMBODIMENTS

Referring to FIG. 1, a pile driving system or apparatus 10, also referred to herein as a pile driver, comprises a hammer 12, also known as a ram, which is used to impact the top of a pile 14 so as to drive the pile 14 into the ground 16. In one embodiment, the pile driver 10 is a diesel pile driver. It should be appreciated that embodiments of the present invention can be applied to other types of pile drivers, such as hydraulic pile drivers, pneumatic pile drivers and drop hammers.

Located on the hammer 12 is a velocity sensor 20 that is capable of measuring the velocity of the hammer 12 just before it impacts the pile 14. The velocity sensor 20 may include two magnetic proximity switches (not shown). The pair of magnetic proximity switches may be located, for example, on the side of the hammer 12. In one embodiment, the proximity switches are set to close approximately 1 inch above impact. The time elapsed between the closing of the magnetic proximity switches is transduced into a velocity reading. Alternatively, the velocity sensor 20 could be radar, such as a Doppler radar, which uses the phase shift of a return signal to compute the velocity of the hammer 12.

The velocity sensor 20 sends a reading signal 22 to a display and user input unit 24. The display and user input 24 may be a personal computer with a keyboard and monitor, for example. A user might enter parameters such as any one or more of: a maximum sound pressure, a maximum vibration, a target impact energy, a target impact force, and a target pile capacity through a user interface of the display and user input unit 24. These parameters could be based on soil conditions and the type of pile to be driven, for instance.

The display and user input unit 24 interfaces with a controller, represented in FIG. 1 as control logic 26, which is thus operatively coupled to the velocity sensor 20 indirectly through the display and user input unit 24. The control logic 26 is operatively coupled to, and controls, a hydraulic control system 28, which derives its hydraulic power from a hydraulic reservoir 30. The display and user input unit 24, the control logic 26, and the hydraulic control system 28 together represent one possible implementation of a pile driving control apparatus 25.

The hydraulic control system 28 regulates the hydraulic pressure in a hydraulic control line 32. The hydraulic control line 32 is connected to a fuel system throttle 34, which opens and closes in response to variations in hydraulic pressure in the hydraulic control line 32. The opening and closing of the fuel system throttle 34 regulates the stroke output of the diesel pile driver, thereby causing the hammer 12 to move faster or slower. The control logic 26 thus regulates the fuel system throttle 34 and hence the velocity of the hammer 12 based on the signal 22 from the velocity sensor 20. Therefore, the pile driver 10 can be said to incorporate a velocity-feedback control system to ensure that the correct impact energy is imparted to the pile 14.

According to an aspect of the-invention, the pile driver 10 includes, instead of or in addition to the velocity sensor 20, at least one other type of sensor or transducer 21. Each other sensor 21 is operatively coupled to the control logic 26, through the display and user input unit 24 in the example shown in FIG. 1, and provides readings 23 as inputs to the control logic. Although shown as being located on the hammer 12 in FIG. 1, a sensor 21 is disposed at a control location that may be on the hammer, on the pile 14, or at some other location such as on the ground 16 or on a nearby structure (not shown). The control logic 26 may thus generate a control signal for the hydraulic control system 28 based on hammer velocity and/or other inputs. One or more sensors 21 may be provided to measure any of: sound pressure resulting from dissipation of hammer impact energy as noted above, vibration in the ground 16, and/or in some other structure, and possibly other quantities or conditions. A sound pressure sensor might be provided in the form of a microphone or other acoustic transducer, and a geophone or accelerometer could be used as a vibration sensor, for example.

In operation, the velocity sensor 20 measures the velocity of the hammer 12 and sends a signal 22 to the control logic 26 via the energy display and user input unit 24. Each other sensor 21 similarly measures a respective quantity and provides inputs 23 to the control logic 26. The control logic 26 may compute the actual impact energy, the actual impact force, or pile capacity, for instance, based on the velocity reading and other inputs, if any, and compare the computed parameter with a target parameter. Target parameters may be predetermined or, in some embodiments, configured by the user.

Impact force, for example, could be calculated by analyzing signals from the velocity sensor 20, after the impact event, to infer the stiffness and/or resistance of the pile 14 being driven. When calibrated to measured forces in the pile 14, which might be provided to the control logic 26 in the form of strain signals by another system such as a pile driving analyzer ("PDA"), signals from the velocity sensor 20 could be used to infer the impact force of the hammer 12. Pile capacity might be calculated by the control logic 26 itself or calculated by a PDA or other system and provided to the control logic, for instance, based on collected data and using any of various analytical methods. Data from the velocity sensor 20 could be used to determine hammer rebound time and thereby infer pile capacity, for example.

Thus, it should be appreciated that the control logic 26 may determine any of various quantities by calculating those quantities itself based on measurements or readings, or by receiving inputs from one or more other systems or components that receive measurements and calculate the quantities.

Considering actual impact energy as an illustrative example, if the actual impact energy exceeds the target impact energy, then the control logic 26 intervenes by reducing the velocity of the hammer for the subsequent hammer stroke. To reduce the velocity of the subsequent hammer stroke, the control logic 26 sends a control signal to the hydraulic control system 28, which in turn adjusts the pressure in the hydraulic control line 32. The variation in pressure in the hydraulic control line 32 causes the fuel system throttle 34 to close. This causes the pile driver 10 to decrease its hammer stroke, thereby diminishing the velocity and thus the impact energy of the subsequent hammer stroke. The control logic 26 may similarly cause the hydraulic control system 28 to open the throttle 34 and increase the hammer stroke and impact velocity if the actual impact energy is below a target level.

Impact force is described above solely for the purposes of illustration. The control logic 26 may control the hydraulic control system 28 in a substantially similar manner responsive to a comparison of actual impact force or pile capacity with a corresponding target.

It should also be appreciated that measurements could be used directly in generating a control signal. For example, the control logic 26 need not necessarily determine another parameter based on received inputs. A control signal might instead be generated by the control logic 26 based on sound pressure or based on vibration, without computing or otherwise determining a control parameter such as impact energy, impact force, or pile capacity. Thus, according to embodiments of the present invention, the control logic 26 might determine one or more of sound pressure at a sound pressure control location and vibration at a vibration control location, which may or may not be the same control location, and provide to the hydraulic control system 28 a control signal based on the determined parameters. As will be apparent from the foregoing, the control logic 26 may determine velocity, sound pressure, and/or vibration by receiving readings 22, 23 from sensors 20, 21.

Further refinements to the embodiment shown in FIG. 1 will now be discussed with reference to FIG. 2. In addition to measuring such quantities as velocity, sound pressure, and/or vibration, the pile driver 10 may also have a PDA 40. The PDA 40 receives strain data 41 and acceleration data 42 from transducers located on the side of the pile 14. These transducers are a strain gauge 43 and an accelerometer 44, which are located on the side of the pile 14. The strain gauge 43 provides the strain data 41 and the accelerometer 44 provides the acceleration data 42 to the PDA 40 when the hammer impacts the pile 14 at its pile head 15. The PDA 40 may be implemented in some embodiments in a form that is known in the art (see, e.g., U.S. Pat. No. 6,301,551). The PDA 40 uses strain and acceleration to determine the stress in the pile 14 during impact, based on knowledge of the elastic modulus of the pile. The PDA 40 thus ensures that the pile 14 is not overstressed.

If the stress in the pile 14 is too high, the control logic 26 reduces the velocity of the subsequent hammer stroke by sending a signal to the hydraulic control system 28 which, in turn, regulates the hammer throttle 34 (also known as the fuel system throttle 34). The PDA 40 may also be interfaced with the user input unit 24 so that a user can set the maximum allowable stress. This allows the user to ensure compliance with installation specifications that prescribe a maximum stress on the pile during installation. The user might also or instead input the strength of the material (or select the type of material from a database) and the desired factor of safety. The control logic 26 is then able to determine the maximum allowable stress by dividing the strength of the material by the factor of safety. In a further refinement, the control logic 26 monitors not only compressive stress but also tensile and shear stresses.

Figure 2:
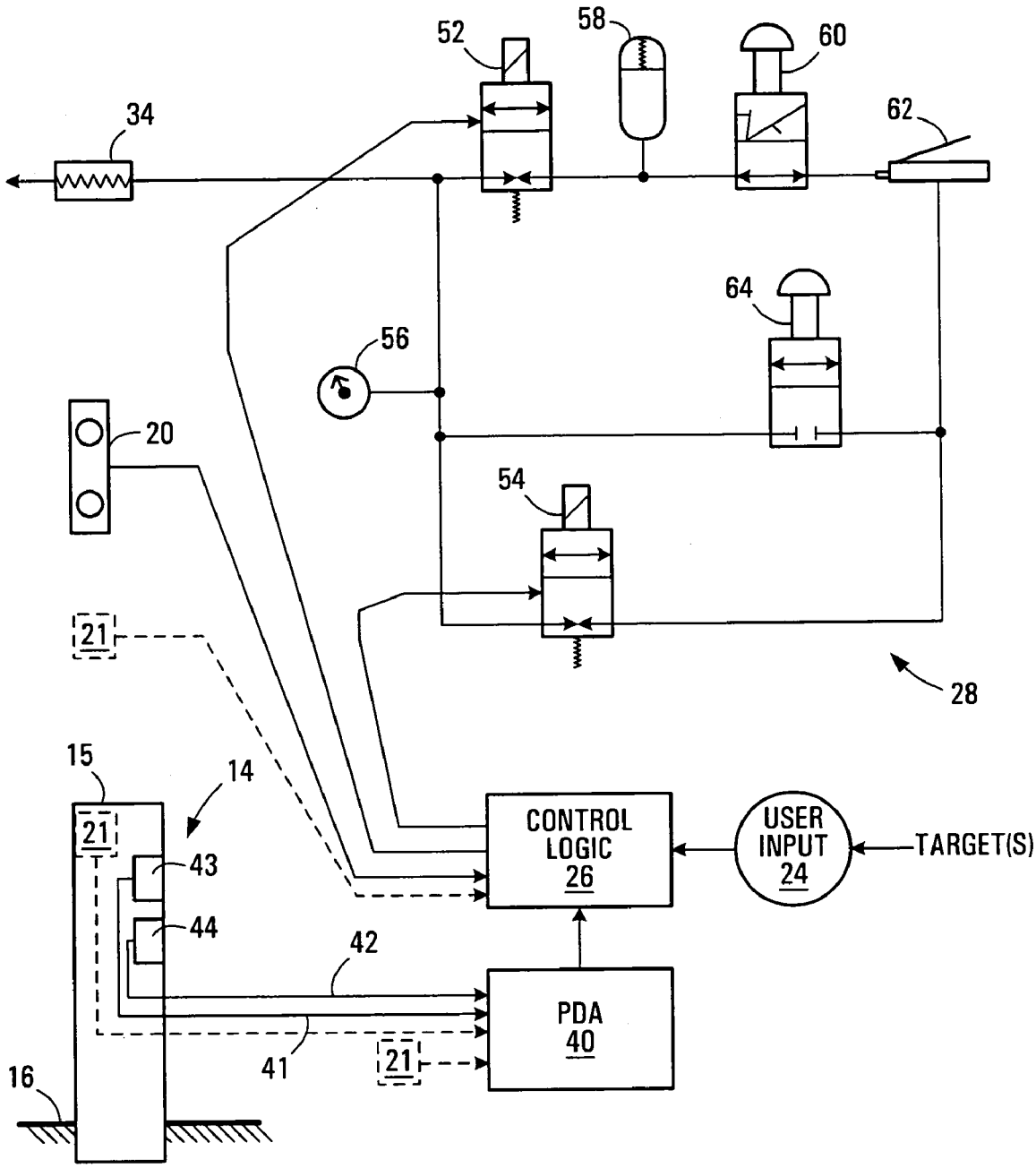
FIG. 2 is a schematic of the pile driving system of FIG. 1 illustrating the interfacing of the control logic with the sensors and hydraulic system.

FIG. 2 also shows possible control locations at which the sensor(s) 21 may be disposed. A sensor 21 that is located on the hammer, like the velocity sensor 20, or possibly at another control location may provide readings to the control logic 26. If a control location at which a sensor 21 is to measure a quantity is on the pile 14, on the ground 16, or on a nearby structure, then readings may be collected, and possible analyzed, by the PDA 40. In the latter case, an analysis output is provided to the control logic 26. A controller, represented in FIG. 2 as the control logic 26, may thus receive an indication of sound pressure or vibration in the form of a reading or measurement from a sensor or in the form of an analysis output from a system such as the PDA 40 that measures and analyzes sound pressure and/or vibration.

Any of various techniques may be used to analyze sound pressure and/or vibration. A conventional PDA could be supplemented with additional processing routines to handle these measured quantities, or an independent system could be used. Thus, although it is noted above that a known PDA may be used as the PDA 40, additional functionality may be added to a PDA in some embodiments.

In the context of sound pressure analysis, a peak sound pressure or a time-weighted average sound pressure could be monitored at a sensitive location or at the perimeter of a construction project, for example, to ensure compliance with project specifications or other regulations governing sound. Similarly, vibration could be monitored at a given location and compared to allowable vibration levels.

The functioning of the hydraulic control system 28 is also depicted in FIG. 2. The control logic 26 regulates an Incafase pressure valve 52 and a Decafase pressure valve 54 which together determine the pressure in the hydraulic control line 32. A pressure gauge 56 may provide feedback to the control logic 26. In the refined embodiment of FIG. 2, a hydraulic pressure accumulator 58 is provided in addition to the hydraulic reservoir 30 shown in FIG. 1. Also provided in the hydraulic control system 28 is a manual override 60, also known as an auto-manual switch. The manual override 60 permits a user to manually adjust the hammer throttle 34 by manually pumping a hydraulic hand pump 62. The hydraulic control system 28 also includes an emergency stop button 64 to stop the hammer 34.

The system may be used to drive any elements into the ground, including piles, posts, and any deep foundation elements. As used herein, the term pile is intended as a general term encompassing any such deep foundation elements. References to piles in this description and the appended claims should be interpreted accordingly.

What has been described is merely illustrative of the application of principles of embodiments of the invention. Other arrangements and methods can be implemented by those skilled in the art without departing from the scope of the present invention.

For example, the various components shown in FIGS. 1 and 2 may be operatively coupled together through different types of connections. With reference to FIG. 1, the reading signals 22, 23 may be provided by the sensors 20, 21 to the control apparatus 25 through wired or wireless connections. Depending on the implementation of the control apparatus 25, interconnections between the display and user input unit 24, the control logic 26, and the hydraulic control system 28 may be in the form of traces on one or more printed circuit boards, or connectors and cables between different boards or devices, for instance. The hydraulic control system 28 is coupled to the hydraulic reservoir 30 and the throttle 34 by hydraulic lines, another type of connection.

In addition, the division of functions shown in FIGS. 1 and 2 is intended for illustrative purposes. Other embodiments may be implemented using further, fewer, or different components that are interconnected in a similar or different manner. A pile driving control apparatus may receive inputs from multiple sensors for instance, including multiple sensors of the same type. It may be desirable to determine sound and/or vibration at a number of control locations around a construction site so that impact velocity of the hammer could be reduced when a parameter determined for any control location exceeds a target level. Different targets could potentially be configured for different control locations.

We claim:

1. A pile driving control apparatus comprising:

a hydraulic control system operable to control a throttle of a pile driving hammer to thereby control an impact velocity of the hammer with a pile; and a controller operatively coupled to the hydraulic control system and operable to determine sound pressure at a control location during a hammer stroke, and to provide to the hydraulic control system a control signal based on the determined sound pressure, the hydraulic control system controlling an impact velocity of the hammer during a subsequent hammer stroke based on the control signal.

2. The pile driving control apparatus of claim 1, wherein the controller is further operable to determine an impact velocity of the hammer during the hammer stroke by receiving a reading from a velocity sensor for measuring the impact velocity of the hammer.

3. The pile driving control apparatus of claim 1, wherein the controller is operable to determine the sound pressure by receiving a reading from a sound pressure sensor for measuring the sound pressure at the control location.

4. The pile driving control apparatus of claim 1, wherein the control location comprises one of: a location on the hammer, a location on the pile, a location on ground into which the pile is to be driven, and a location on a structure near the pile.

5. The pile driving control apparatus of claim 1, wherein the controller is further operable to determine vibration at a vibration control location during the hammer stroke, and to generate the control signal based on the determined sound pressure and the determined vibration.

6. The pile driving control apparatus of claim 5, wherein the control location and the vibration control location comprise the same physical location.

7. The pile driving control apparatus of claim 5, wherein the controller is further operable to determine an impact velocity of the hammer during the hammer stroke by receiving a reading from a velocity sensor for measuring the impact velocity of the hammer.

8. The pile driving control apparatus of claim 5, wherein the controller is operable to determine the vibration by receiving a reading from a vibration sensor for measuring the vibration at the vibration control location.

9. The pile driving control apparatus of claim 5, wherein the vibration control location comprises one of: a location on the hammer, a location on ground into which the pile is to be driven, and a location on a structure near the pile.

10. The pile driving control apparatus of claim 5, wherein the controller is further operable to provide the control signal by comparing the determined vibration to a maximum allowable vibration, and generating, as the control signal, a control signal to cause the hydraulic control system to adjust the throttle so as to adjust the impact velocity of the hammer for the subsequent hammer stroke based on the comparison.

11. The pile driving control apparatus of claim 1, wherein the controller is further operable to provide the control signal by comparing the determined sound pressure to a maximum allowable sound pressure, and generating, as the control signal, a control signal to cause the hydraulic control system to adjust the throttle so as to adjust the impact velocity of the hammer for the subsequent hammer stroke based on the comparison.

12. A pile driving system comprising:

a pile driving hammer comprising a throttle;

a pile driving control apparatus, operatively coupled to the throttle, comprising a hydraulic control system operable to control the throttle to thereby control an impact velocity of the hammer with a pile and a controller operatively coupled to the hydraulic control system and operable to determine sound pressure at a control location during a hammer stroke, and to provide to the hydraulic control system a control signal based on the detennined sound pressure, the hydraulic control system controlling an impact velocity of the hammer during a subsequent hammer stroke based on the control signal; and a sound pressure sensor, operatively coupled to the controller, and operable to measure the sound pressure at the control location and to provide to the controller an indication of the measured sound pressure.

13. The pile driving system of claim 12, wherein the sound pressure sensor comprises a system for analyzing the sound pressure at the control location, the indication of the measured sound pressure comprising a sound pressure analysis output.

14. The pile driving system of claim 12, wherein the controller is further operable to determine vibration at a vibration control location during the hammer stroke and to generate the control signal based on the determined sound pressure and the determined vibration, and wherein the pile driving system further comprises:

a vibration sensor, operatively coupled to the controller, and operable to measure the vibration at the vibration control location and to provide to the controller an indication of the measured vibration.

15. The pile driving system of claim 14, wherein the vibration sensor compnses a system for analyzing the vibration at the vibration control location, the indication of the measured vibration comprising a vibration analysis output.

* * * * *